US005603431A

United States Patent [19]

Tuller

[11] Patent Number: 5,603,431

[45] Date of Patent: Feb. 18, 1997

[54] CONTROL MECHANISM FOR DISPENSING FLUENT MATERIALS

[75] Inventor: Barry E. Tuller, Newton, Iowa

[73] Assignee: Maytag Corporation, Newton, Iowa

[21] Appl. No.: 422,040

[22] Filed: Apr. 14, 1995

[51] Int. Cl.[6] ..... B67D 5/14

[52] U.S. Cl. ..... 222/63; 134/58 D; 222/651

[58] Field of Search ..... 222/54, 63, 129, 222/518, 651, 652; 134/56 D, 57 D, 58 D

[56] References Cited

U.S. PATENT DOCUMENTS

| | | | |
|---|---|---|---|
| 3,220,607 | 11/1965 | Seal | 222/651 X |
| 3,411,671 | 11/1968 | Harvey et al. | 222/70 |
| 3,419,190 | 12/1968 | Kauffman et al. | 222/129 X |
| 3,426,944 | 2/1969 | French | 222/129 |
| 3,827,600 | 8/1974 | Janke | 222/70 |
| 3,850,185 | 11/1974 | Guth | 222/652 X |
| 4,149,654 | 4/1979 | Nelson et al. | 222/70 |
| 4,355,738 | 10/1982 | Herbst et al. | 222/129 |
| 4,732,171 | 3/1988 | Milocco | 134/57 D |
| 4,805,647 | 2/1989 | Marks | 134/57 D |
| 4,820,934 | 4/1989 | Marcade et al. | 134/57 D X |
| 4,974,750 | 12/1990 | Welch | 222/129 |
| 5,005,740 | 4/1991 | Marks et al. | 222/651 |
| 5,133,487 | 7/1992 | Russi | 222/651 |
| 5,205,304 | 4/1993 | Cooper et al. | 222/651 X |

*Primary Examiner*—Joseph Kaufman
*Attorney, Agent, or Firm*—Zarley, McKee, Thomte, Voorhees & Sease

[57] ABSTRACT

A control mechanism for dispensing fluent materials includes a linkage mechanism actuatable by a single drive member to cause release of a first fluent material from a first dispenser when the drive member is initially moved. The linkage mechanism causes the release of a second fluent material from a second dispenser when the drive member is moved a second time.

10 Claims, 8 Drawing Sheets

CONTROL MECHANISM FOR DISPENSING FLUENT MATERIALS

BACKGROUND OF THE INVENTION

The present invention relates to a control mechanism for dispensing fluent materials, and particularly for dispensing fluent materials in an automatic dishwasher.

Most dishwashers include at least two dispensers for dispensing fluent materials into the washing compartment during the washing of the dishes. One of these dispensers contains detergent, usually in a granulated form, and the other of these dispensers contains liquid rinse aid, which is usually some form of wetting agent to be added to the water so as to reduce water marks on the dishes being washed.

Most prior art dishwashers include two drivers, one for actuating one of the dispensers, and the other for actuating the other of the dispensers. During the washing cycle the first driver is actuated to release the detergent from the detergent dispenser, and later on in the cycle the second driver is actuated to release rinse aid from the rinse aid dispenser.

Therefore a primary object of the present invention is the provision of an improved control mechanism for dispensing fluent materials.

A further object of the present invention is the provision of an improved dispensing control mechanism which permits the dispensing of multiple fluent materials by means of one driver and a unique linkage mechanism.

A further object of the present invention is the provision of an improved control mechanism for dispensing fluent materials which is simple in construction, durable in use, and efficient in operation.

SUMMARY OF THE INVENTION

The foregoing objects may be achieved by a control mechanism mounted on a support and containing at least first and second dispensers. The dispensers contain first and second fluent materials respectively and each have first and second release mechanisms which are movable from a hold position holding the first and second fluent materials in the first and second dispensers respectively to a release position releasing at least a portion of the first and second fluent materials from the first and second dispensers respectively.

The control mechanism includes a linkage mechanism engaging the first and second release mechanisms. The linkage mechanism is movable to a first linkage position wherein the first and second release mechanisms are both in their respective hold positions. Next the linkage mechanism is movable from the first linkage position to a second linkage position wherein the first release mechanism is in its release position and the second release mechanism is in its hold position. The linkage mechanism is then movable from the second linkage position to a third linkage position wherein the first and second release mechanisms are both in their release positions. A single power means includes a single power member connected to the linkage mechanism and is actuatable to cause movement of the linkage mechanism sequentially from its first linkage position to its second linkage position to its third linkage position.

The single power means is preferably a wax motor having a longitudinally extensible member, but other types of extensible power means may be used such as solenoids, pneumatically operated cylinders, hydraulically operated cylinders, or other power means for creating reciprocating movement. While the reciprocating movement is preferably in a longitudinal direction, it would also be possible to utilize power means which reciprocate in a rotating or arcuate direction as well.

DETAILED DESCRIPTION OF THE PREFERRED EMBODIMENT

Figure 4:
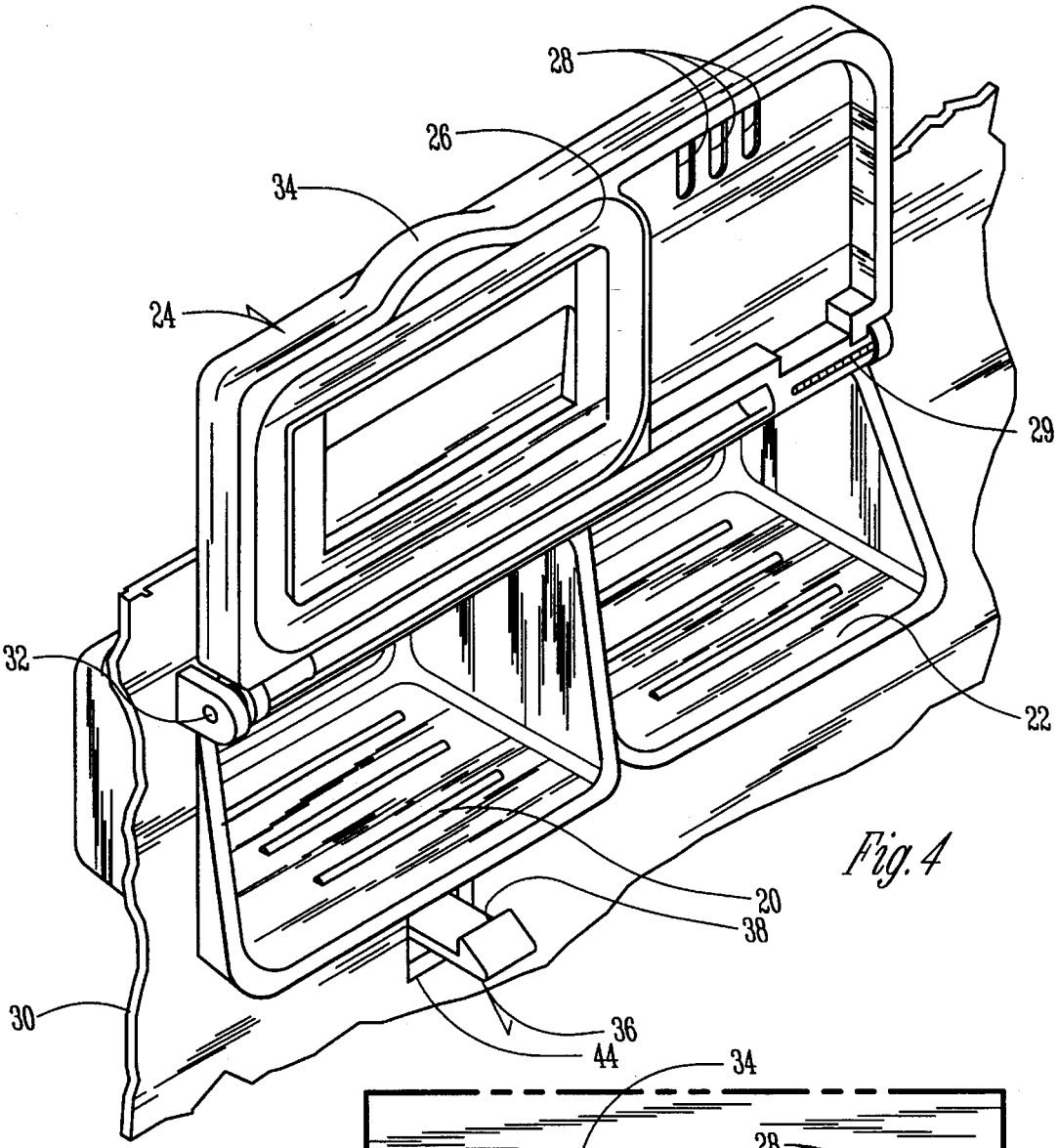
FIG. 4 is an enlarged pictorial view of the detergent dispenser of the present invention.
Figure 5:
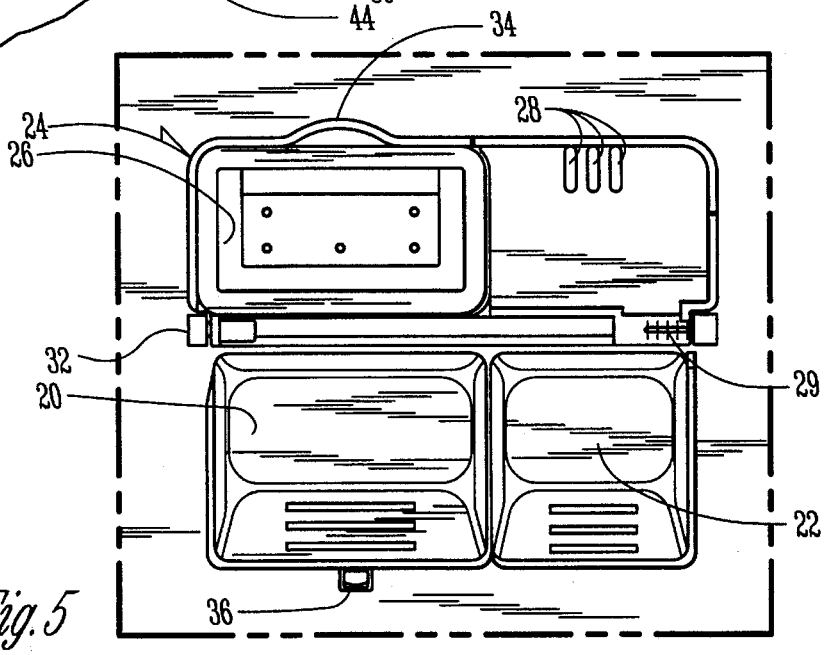
FIG. 5 is a front elevational view of the detergent dispenser of FIG. 4.

Referring to the drawings a dishwasher 10 includes a door 12 enclosing a washing chamber 14. Door 12 contains a detergent dispenser 16 a rinse aid dispenser 18. Dispenser 16 includes two detergent cups 20, 22 (FIG. 4) which are adapted to contain granulated or liquid detergent. A dispenser lid 24 includes a seal rim 26 for sealing over detergent cup 20 and a plurality of prewash apertures 28 which provide communication from detergent cup 22 to the interior of the washing chamber 14. Lid 24 is hinged to the interior panel 30 of door 18 by means of a hinge 32. Lid 24 also includes a latching lip 34 which is adapted to retentively engage a latch 36. Latch 36 includes a first pawl 38 for engaging latching lip 34. Latch 36 also is comprised of a latch neck 40 (best seen in FIG. 10) having a second pawl 42 on its inner end. Latch 36 extends through a latch opening 44 in interior panel 30 and is pivoted about a fulcrum located at that opening 44. A spring 46 is hooked at its upper end over the neck 40 of latch 36 and is hooked at its lower end to a linkage frame 48 having a spring receiving hook 52 thereon. Linkage frame 48 is secured to panel 30 by means of screws 50 (FIG. 9).

A wax motor 54 is operatively secured to the linkage frame 48 and includes an extensible piston 56 having at its outer end a notch 58 and a snap node 60 for securing it to a drive link 62. In this embodiment, the wax motor 54 is a type 100331 10 supplied by "Eltek" of Italy.

Drive link 62 includes an inclined cam surface 64 on its upper edge (FIG. 9) which is adapted to bear against the neck 40 of latch 36. Drive link 62 also includes a stiffening rib 65 extending along its side. Drive link 62 also includes at its end a guide finger 66 which extends through a guide hole 68 in the linkage frame 48 (FIG. 9).

Figure 6:
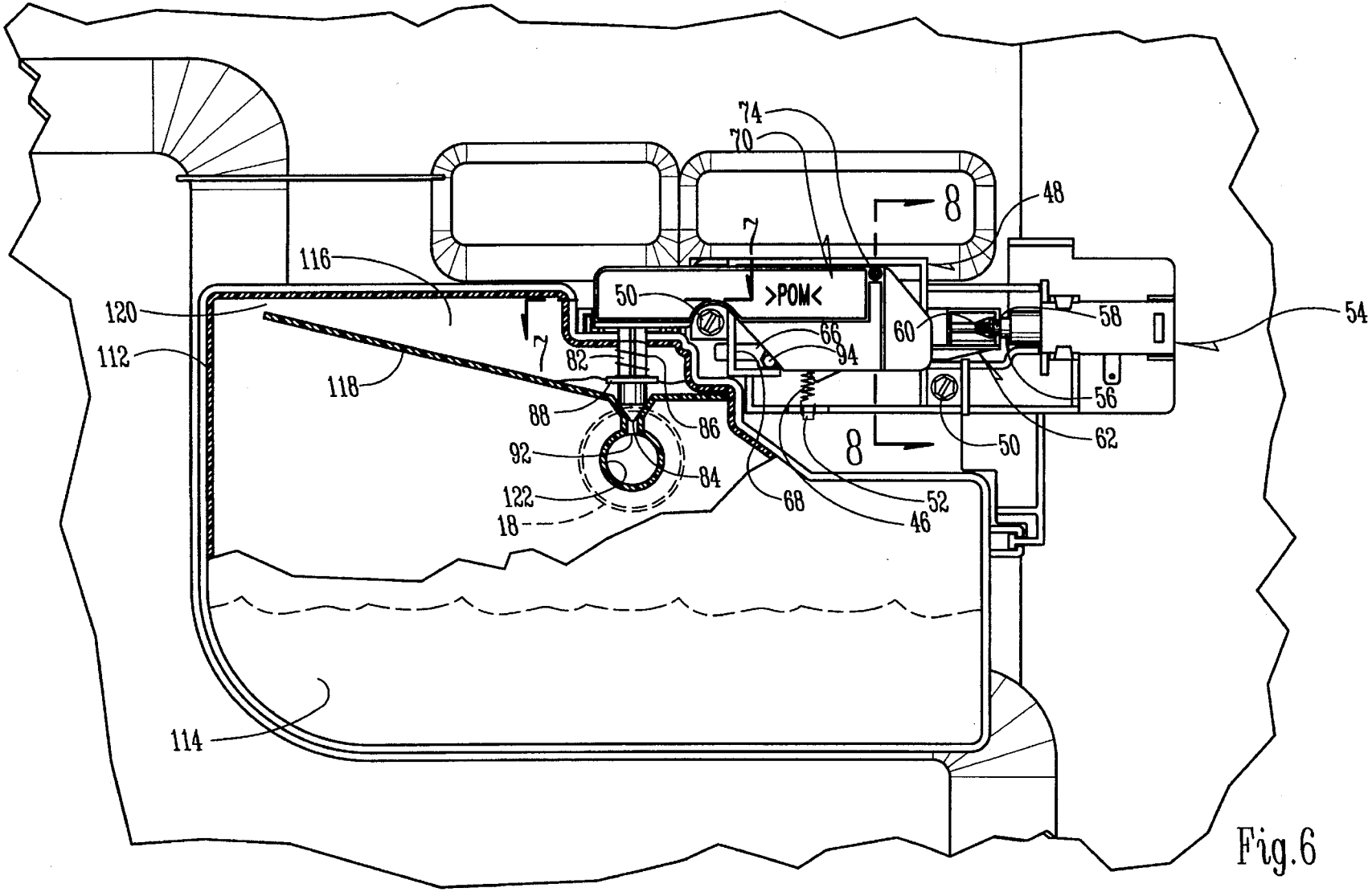
FIG. 6 is a sectional view taken through the door of the dishwasher along line 6—6 of FIG. 2.
Figure 7:
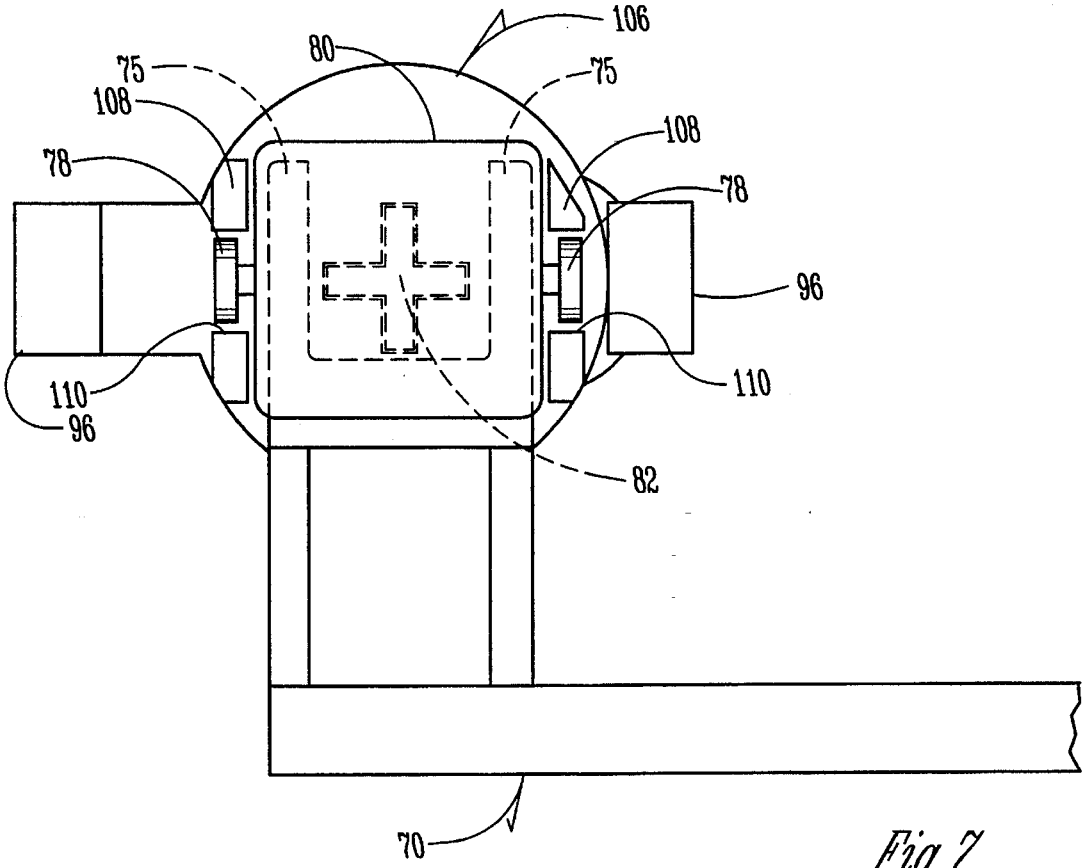
FIG. 7 is a top plan view taken along line 7—7 of FIG. 6.
Figure 8:
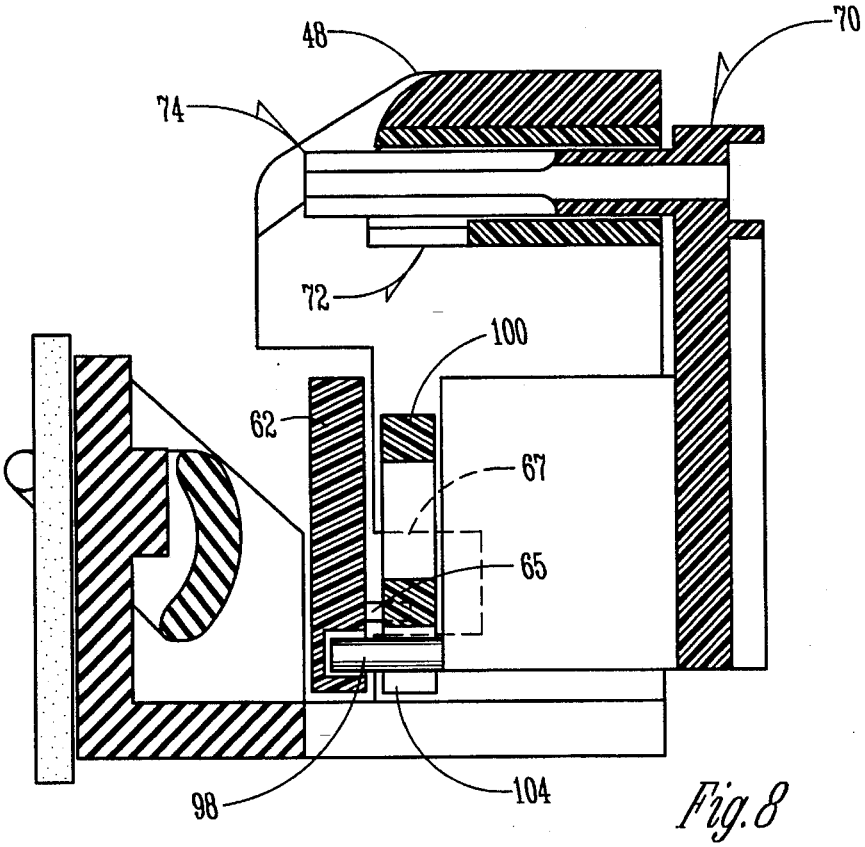
FIG. 8 is a sectional view taken along line 8—8 of FIG. 6.
Figures 9, 10:
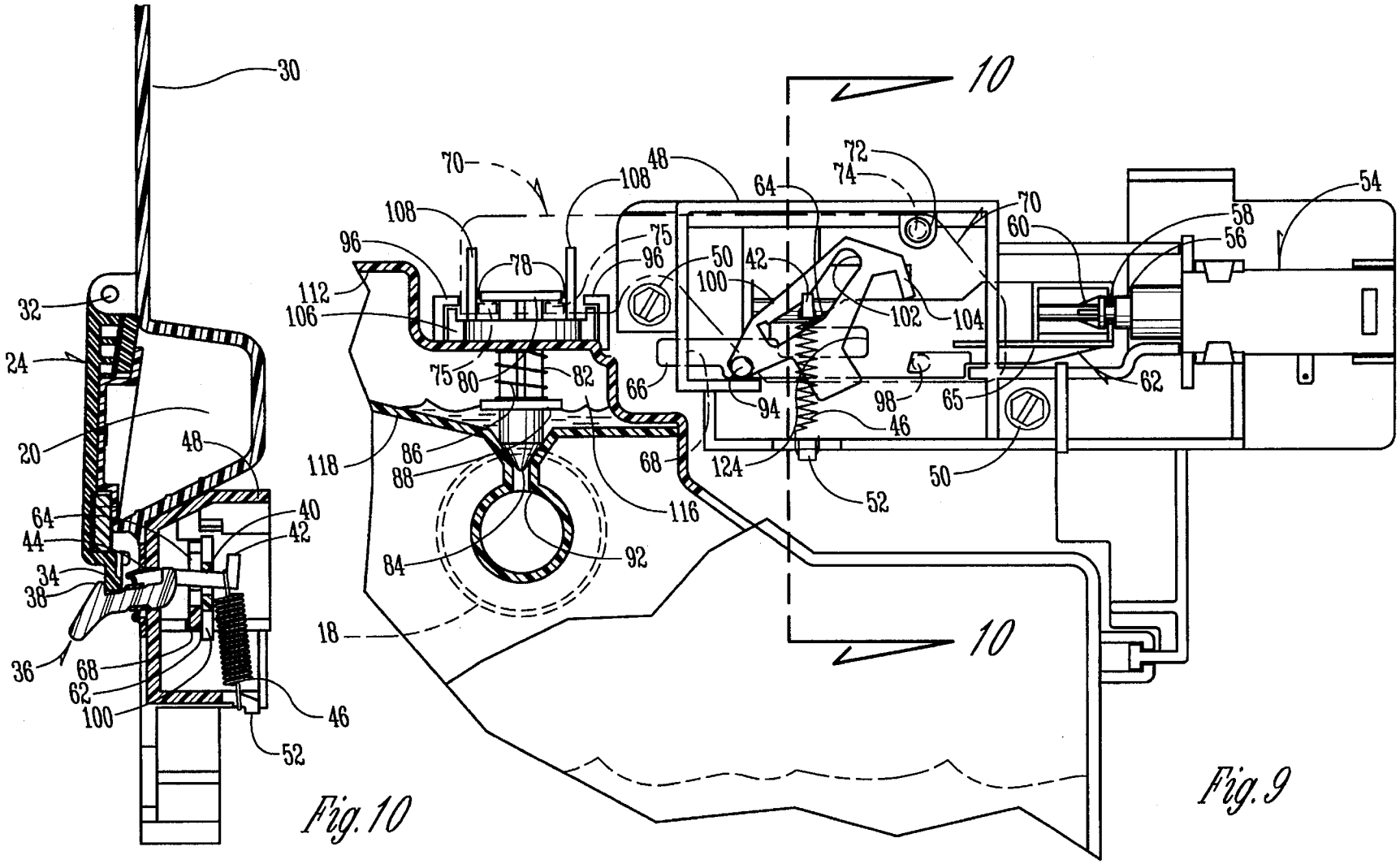
FIG. 9 is a plan view similar to FIG. 6, but showing the driven link in shadow lines and showing the actuator in a retracted position.
FIG. 10 is a sectional view taken along line 10—10 of FIG. 9.

A driven link 70 is pivotally mounted to a pivot ear 72 on linkage frame 48 by means of a pivot pin 74 as best seen in FIGS. 6, 8, and 9. Driven link 70 includes a pair of prongs 75 (FIGS. 7 and 9) which project at a right angle to the plane defined by the driven link 70. Driven link 70 also includes a coupling pin 98 (FIG. 8) which projects perpendicularly from the link 70.

Figure 1:
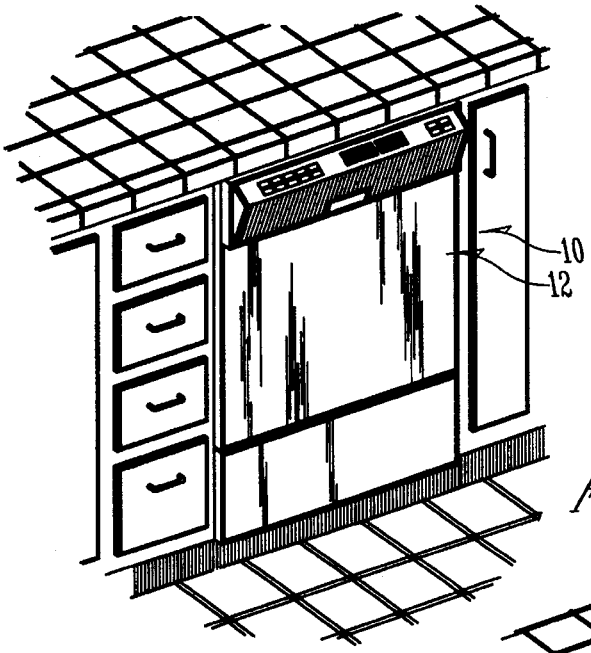
FIG. 1 is a pictorial view of a dishwasher mounted beneath a cabinet.
Figure 2:
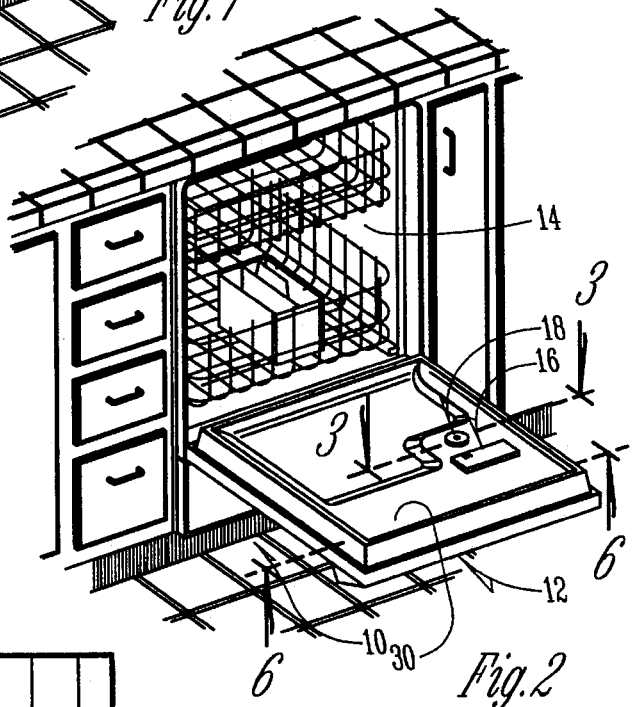
FIG. 2 is a view similar to FIG. 1, but showing the door of the dishwasher in an open position.
Figure 3:
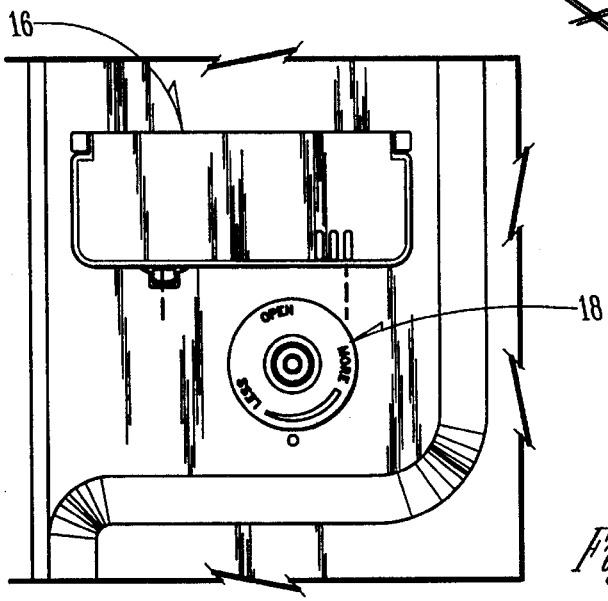
FIG. 3 is an enlarged detailed view taken along line 3—3 of FIG. 2.

Referring to FIG. 6 a rinse aid housing 112 includes a main chamber 114 for containing rinse aid solution and an outlet chamber 116 which is separated from chamber 114 by means of a separating baffle 118. Separating baffle 118 terminates short of the wall of rinse aid housing 112 so as to create a refill aperture 120 between chambers 114, 116. When the door is lowered to its position shown in FIG. 2 the rinse aid flows through refill aperture 120 from main chamber 114 to outlet chamber 116. Outlet chamber 116 communicates with a bore 122 through an outlet opening 92. Bore 122 is in communication with rinse aid dispenser 18 on the interior of door 12 and permits the rinse aid to flow from bore 122 through the dispenser 18 into the interior of washing chamber 14.

A plunger head 80 (FIG. 9) is connected to a plunger shank 82 which extends through the rinse aid housing 112 into the outlet chamber 116. At the lower end of shank 82 is a plunger valve surface 84 which fits within outlet opening 92 and provides a valve for that opening. A plunger spring 86 is compressed between the rinse aid housing 112 and a flange 88 near the lower end of plunger shank 82. This yieldably urges the valve surface into sealing engagement within the outlet opening 92.

A guide member 106 (FIGS. 7 and 9) includes two spaced apart pairs of guide arms 108 which form guide slots 110 therebetween. Guide slots 110 are adapted to receive a pair of outwardly projecting guide pins 78 on the plunger head 80 so as to guide the plunger as it moves vertically up and down against the bias of spring 86. The guide member 106 is press fitted between a pair of spaced apart L-flanges 96 formed integrally with the rinse aid housing 112.

Between drive link 62 and driven link 70 is a connecting link 100. Link 100 includes a latch receiving slot 102 and has a coupling hook 104 formed at one end thereof. Connecting link 100 is pivotally mounted to the drive link 62 for pivotal movement about the axis 94. As can best be seen in FIG. 9 and 10 the neck 40 of latch 36 extends through the slot 102 in connecting link 100 and is guided within slot 102 during pivotal movement of the connecting link 100. The coupling hook 104 of connecting link 100 is movable from an elevated position shown in FIG. 9 to a lowered position shown in FIG. 13 wherein it hooks around the coupling pin 98 and couples the drive link 62 to the driven link 70.

The method of operating the device is as follows. Before the washing cycle begins the lid 24 is in its open position shown in FIG. 4. Granulated or liquid detergent is placed within the detergent cups 20, 22, and the lid 24 is pivoted to its closed position shown in FIG. 10. In moving to this position the lid causes first pawl 38 to pivot downwardly and then snap upwardly to the position shown in FIG. 10 so that it retains the lid 24 in its closed position. Lid 24 is spring mounted by a spring 29 which causes the lid to pivot to its open position of FIG. 4. Spring 46 (FIG. 10) yieldably urges pawl 38 of latch 36 downwardly in a counterclockwise direction as viewed in FIG. 10. In this position the neck 40 causes the connecting link 100 to pivot upwardly to its position shown in FIG. 9 with the coupling hook 104 out of engagement with the coupling pin 98 of driven link 70. Also in this initial position the wax motor 54 is in its retracted position.

Figures 11, 12:
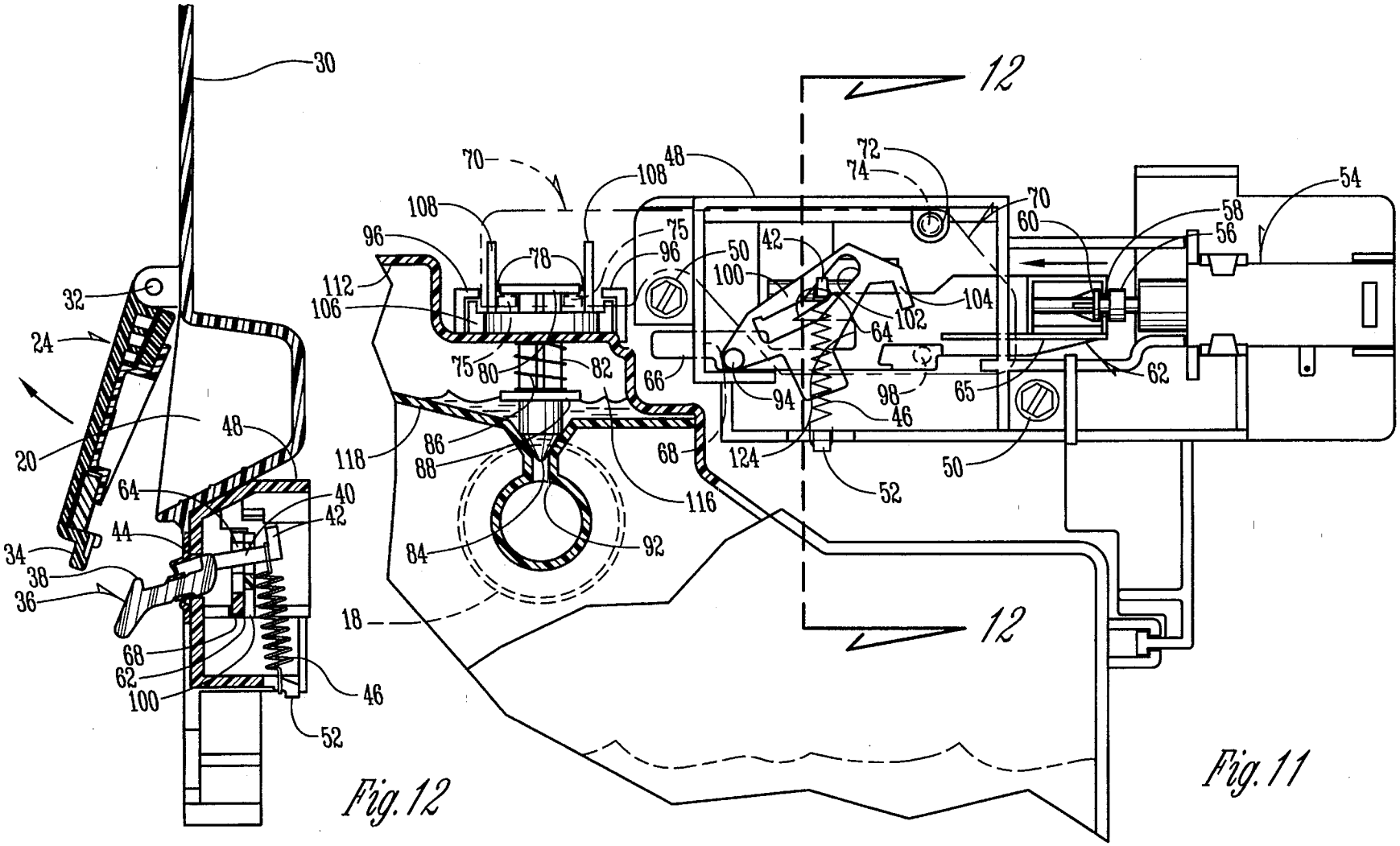
FIG. 11 is a view similar to FIG. 9, but showing the driver in its extended position.
FIG. 12 is a sectional view taken along line 12—12 of FIG. 11.

As the washing cycle begins, detergent passes out of the prewash cup 22 through openings 28. Then at some predetermined point in the cycle, the wax motor 54 is actuated by heating it. The means for actuating and heating the wax motor 54 are not shown but are well known in the art. This causes extension of the piston 56 and movement of the drive link 62 to the position shown in FIG. 11. While moving to the left the cam surface 64 of drive link 62 engages the neck 40 of latch 36 and lifts it up so as to create a counterclockwise movement of the latch 36. This causes the pawl 38 to move out of engagement with the latching lip 34 of lid 24, thereby permitting the lid 24 to pivot upwardly out of closing relationship over the dispenser cup 20. The contents of dispenser cup 20 are thus released into the washing chamber 14. Because the connecting link 100 is in its elevated position shown in FIG. 11, the longitudinal movement of drive link 62 has no effect on the driven link 70 and the driven link 70 remains motionless. Consequently there is no release of rinse aid material from the rinse aid dispenser 18.

Figure 13:
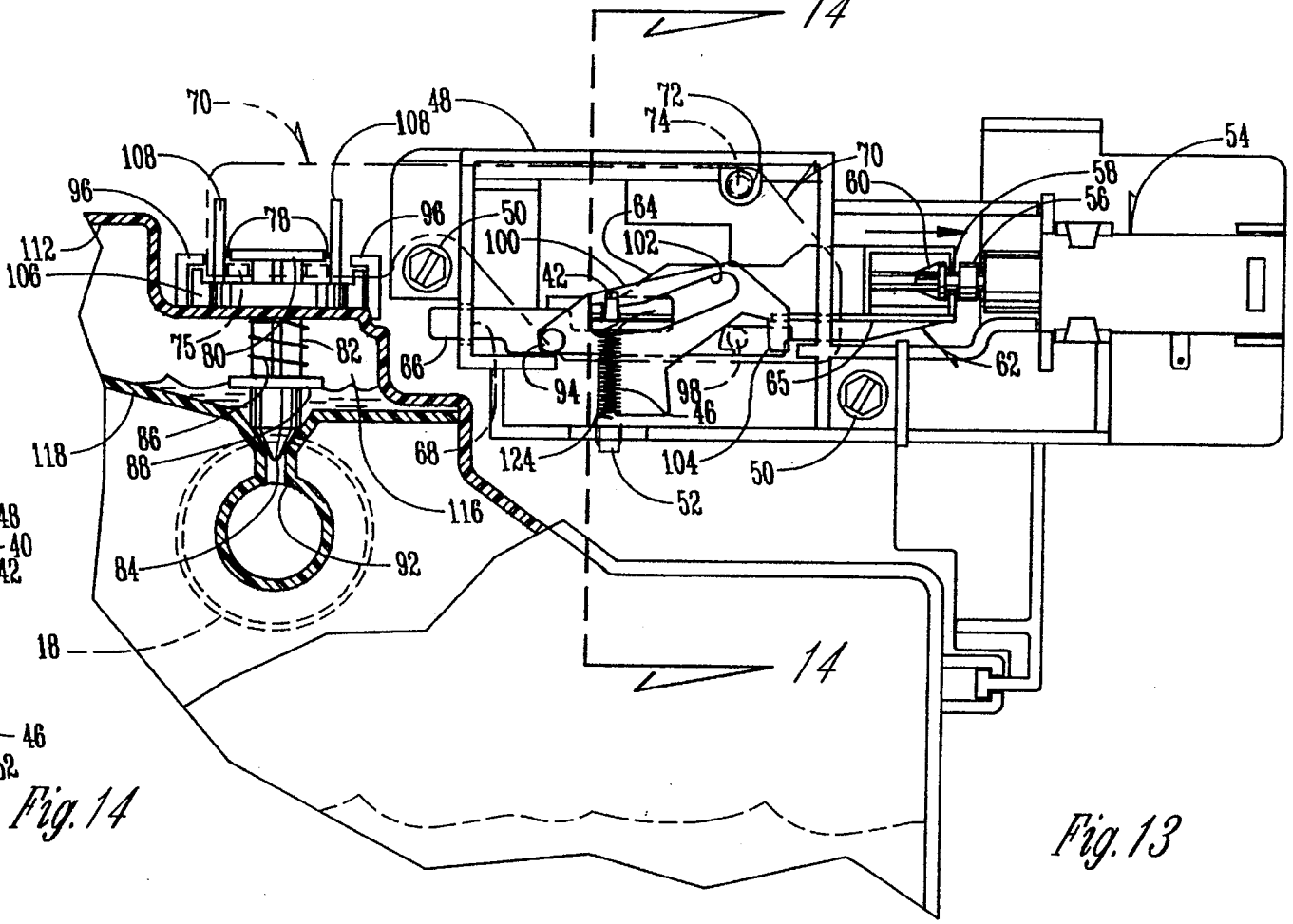
FIG. 13 is a view similar to FIG. 9 and 11, but showing the driver in its retracted position after it has been extended once in the washing cycle.
Figure 14:
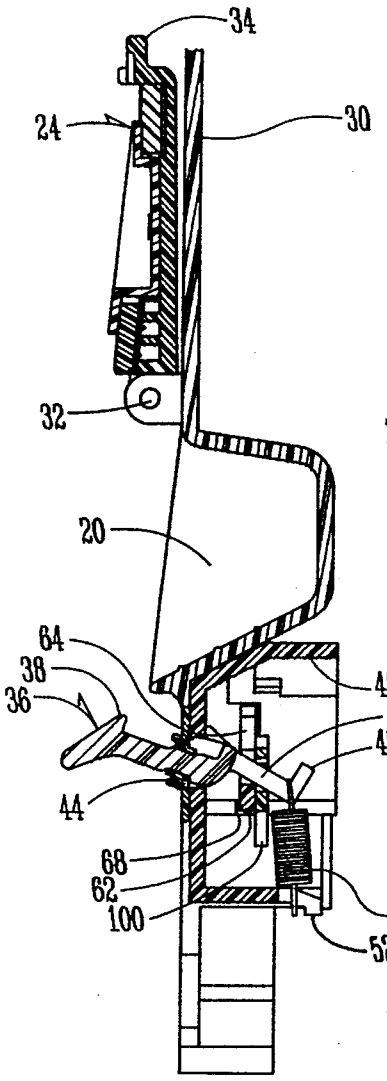
FIG. 14 is a sectional view taken along line 14—14 of FIG. 13.

After the detergent has been released, the wax motor 54 is deactuated, thereby causing the piston 56 to retract and pull the drive link 62 to the right as shown in FIG. 13. The spring 46 urges the latch 36 in a clockwise direction, and because the cam surface 64 is no longer in engagement with the neck 40 of latch 36, the neck 40 moves downwardly to the position shown in FIGS. 13 and 14. This downward movement forces the connecting link 100 to pivot in a clockwise direction so that the hook portion 104 hooks over the coupling pin 98 of driven link 70 as shown in FIG. 13.

Figure 15:
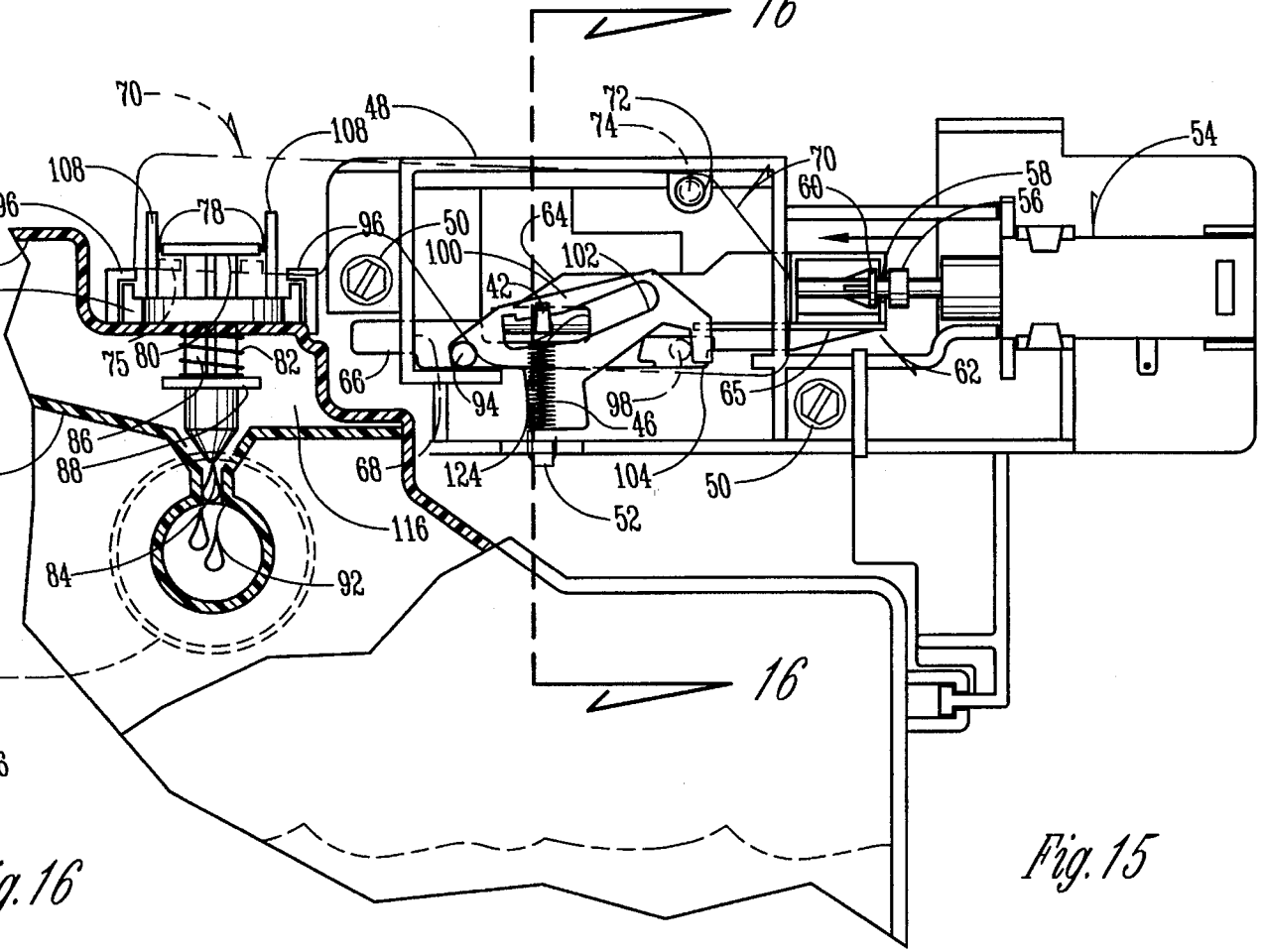
FIG. 15 is a view similar to FIGS. 9, 11, and 13 but showing the position of the driver in its extended position during the second time it is extended.
Figure 16:
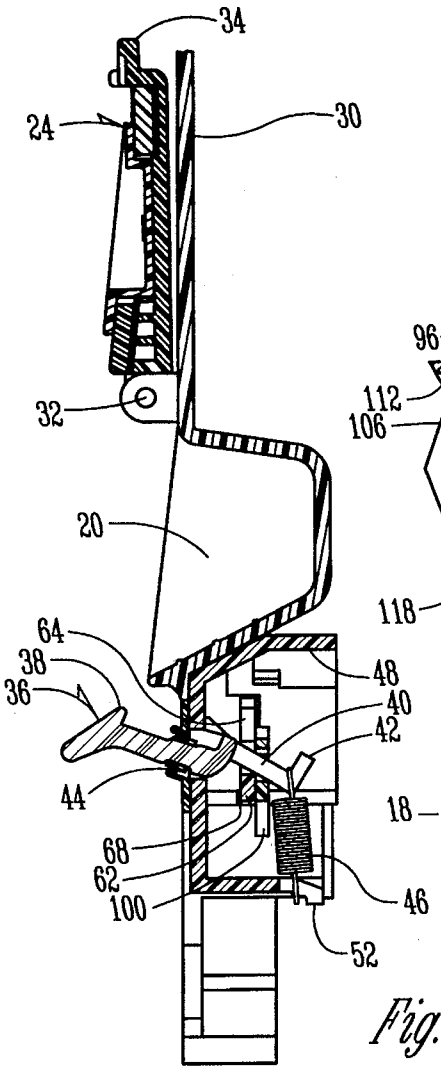
FIG. 16 is a sectional view taken along line 16—16 of FIG. 15.

At a later time in the cycle, the wax motor 54 is again actuated so as to cause it to extend to the position shown in FIG. 15. During this second extension, the neck 40 is positioned below the inclined cam surface 64, and instead slides within a horizontal slot 124 (FIG. 15) of drive link 62. However, the horizontal movement of drive link 62, because of its connection to connecting link 100 at 94, causes the connecting link 100 to move to the left as viewed in FIG. 15. This causes the coupling hook 104 to act upon coupling pin 98 and move it to the left, resulting in a clockwise pivotal movement of the driven link 70 about its pivotal axis 74. As can be seen in FIG. 15 this clockwise movement of driven link 70 causes the prongs 75 to lift upwardly on the plunger head 80, thereby lifting the plunger valve surface 84 upwardly out of seating engagement with the outlet opening 92. The opening of outlet opening 92 permits the rinse aid fluid to escape into bore 122 and outwardly through the rinse aid dispenser 18 on the interior of the door. Thus rinse aid is released into the washing chamber 14 with the second extension of the piston 56.

When the washing cycle is complete the door 12 is opened and the lid 24 is in its open position. At the beginning of the next washing operation, the detergent is again placed in the cups 20, 22 and the lid 24 is moved to its closed position. When the door 12 is opened, rinse aid will flow from the main chamber 114 into the outlet chamber 116 preparing the rinse aid dispenser 18 for operation. When the lid 24 moves to its closed position it causes an counterclockwise movement of the latch 36, thereby lifting neck 40 to the position shown in FIG. 9. In this position the neck 40 is above the cam surface 64, and therefore the device is reset to begin operation for a new washing cycle. Upon the first extension of piston 56 the lid 24 will be opened, and upon the second extension of the piston 56 during the cycle, the rinse aid plunger will be lifted to release rinse aid into the washing compartment.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A control mechanism for dispensing first and second fluent materials comprising:

a support;

a first dispenser on said support and having a first dispenser chamber for holding said first fluent material and having a first release mechanism movable from a holding position for preventing said first fluent material from exiting said first dispenser chamber to a release position for causing at least a portion of said first fluent material to exit from said first dispenser chamber, said first release mechanism including a spring-biased latch mounted on said support;

a second dispenser on said support having a second dispenser chamber for holding said second fluent material and having a second release mechanism movable from a holding position for preventing said second fluent material from exiting said second dispenser chamber to a release position for causing at least a portion of said second fluent material to exit said second dispenser chamber;

a power means having a movable power member, said power means being energizable to move said power member to an actuated position and being deenergizable to move said power member to a deactuated position;

a linkage mechanism connected to said power member of said power means and comprising a movable drive link driven by said power member for movement into engagement with said first release mechanism in response to movement of said power member to said actuated position whenever said first release mechanism is in said holding position, said drive link being selectively coupled to a driven link by a connecting link pivotally connected to said drive link, said drive link and said connecting link being operatively connected to said first release mechanism by said spring-biased latch, said connecting link being movable between an uncoupled position wherein said drive link and said driven link are disconnected from one another and a coupled position wherein said drive link and said driven link are coupled with one another, said driven link operatively engaging said second release mechanism;

said spring-biased latch engaging said connecting link such that only when said first release mechanism is in said release position is said connecting link yieldably urged to couple said drive link and said driven link;

said linkage mechanism being responsive to movement of said power member to said actuated position for engaging and moving only said first release mechanism to said release position whenever said first release mechanism is in said holding position and for engaging and moving only said second release mechanism to said release position whenever said first release mechanism is not in said holding position.

2. A control mechanism according to claim 1 wherein said driven link is moved to said coupled position responsive to movement said power member toward deactuated position after actuation of said first release mechanism.

3. A control mechanism-according to claim 1 wherein said spring-biased latch comprises a tension spring and a latch having a pawl extending therefrom into engagement with said drive link and said connecting link, said spring having one end connected to said pawl and another end connected to said support.

4. A control mechanism according to claim 3 wherein said drive link has an inclined cam surface thereon for engaging said pawl and a slot therethrough for receiving said pawl.

5. A control mechanism according to claim 3 wherein said connecting link has a cam slot therethrough for receiving said pawl without substantial pivotal movement of said connecting link with respect to said drive link while said drive link moves said first release mechanism to a release position and thereafter said cam slot allows said connecting link to pivot in a clockwise direction.

6. A control mechanism according to claim 1 wherein said driven link includes a pin protruding into a groove on the drive link and said connecting link includes a coupling hook thereon for selectively engaging said pin to couple said drive link and said driven link together when said connecting link is pivoted in a clockwise direction to said coupled position.

7. A control mechanism according to claim 1 wherein said driven link is pivotally connected to said support and rotates in response to movement of said drive link and power member when coupled to said drive link by said connecting link.

8. A control mechanism according to claim 1 wherein said power means is a wax motor.

9. A control mechanism for multiple dispensers mounted on a support comprising:

a first dispenser mounted on said support and having a lid mounted for movement from a closed position to an open position;

a latch movably mounted to said support for movement from a latched position engaging said lid and holding said lid in said closed position to an unlatched position freeing said lid for movement to said open position;

a second dispenser mounted on said support having an actuator movable from an inoperative position to an operative position to cause release of the contents of said dispenser;

a linkage mechanism having a latch engaging portion engaging said latch, an actuator engaging portion engaging said actuator, and a drive link;

a single power means having a power member engaging said drive link and being energizable for moving said power member and said drive link from a deactuated position to an actuated position, said power means being deenergizable to cause return of said power member and said drive link to said deactuated position;

said latch engaging portion of said linkage mechanism responding to movement of said power member and said drive link to said actuated position to move said latch from said latched position to said unlatched position whenever said latch holds said lid in said closed position;

said actuator engaging portion of said linkage mechanism responding to movement of said drive link and said power member to said actuated position to move said actuator of said second dispenser to said operative position whenever said latch is not holding said lid in said closed position;

said linkage mechanism further comprises a driven link engaging said actuator of said second dispenser, and a connecting link movable from a coupled position coupling said drive link to said driven link to an uncoupled position decoupling said drive link from said driven link.

10. A control mechanism according to claim 9 wherein said latch engages said connecting link and holds said connecting link in said uncoupled position whenever said latch is holding said lid in said closed position, said latch causing said connecting link to move to said coupled position whenever said lid is in said open position.

* * * * *